US005249586A

United States Patent [19]

Morgan et al.

[11] Patent Number: 5,249,586

[45] Date of Patent: Oct. 5, 1993

[54] ELECTRICAL SMOKING

[75] Inventors: Constance H. Morgan, Midlothian; Walter A. Nichols, Richmond, both of Va.

[73] Assignee: Philip Morris Incorporated, New York, N.Y.

[21] Appl. No.: 12,799

[22] Filed: Feb. 2, 1993

Related U.S. Application Data

[63] Continuation of Ser. No. 666,926, Mar. 11, 1991, abandoned.

[51] Int. Cl.[5] ..... A24F 1/00

[52] U.S. Cl. ..... 131/194; 131/270; 131/273; 128/200.14; 128/202.21; 128/203.27

[58] Field of Search ..... 131/194–196, 131/270, 271, 273; 128/200.14, 202.21, 203.27

[56] References Cited

U.S. PATENT DOCUMENTS

| | | | |
|---|---|---|---|
| 1,771,366 | 7/1930 | Wyss et al. . | |
| 1,968,509 | 7/1934 | Tiffany | 219/38 |
| 2,057,353 | 10/1936 | Whittemore, Jr. | 219/38 |
| 2,104,266 | 1/1938 | McCormick | 131/12 |
| 2,442,004 | 5/1948 | Hayward-Butt | 128/200 |
| 2,974,669 | 3/1961 | Ellis | 131/172 |
| 3,200,819 | 8/1965 | Gilbert | 128/208 |
| 3,363,633 | 1/1968 | Weber | 131/178 |
| 3,402,723 | 9/1968 | Hu | 131/185 |
| 3,482,580 | 12/1969 | Hollabaugh | 131/178 |
| 3,804,100 | 4/1974 | Fariello | 131/173 |
| 3,889,690 | 6/1975 | Guarnieri | 131/185 |
| 4,016,061 | 4/1977 | Wasa et al. | 204/192 F |
| 4,068,672 | 1/1978 | Guerra | 131/170 A |
| 4,077,784 | 3/1978 | Vayrynen | 55/146 |
| 4,131,119 | 12/1978 | Blasutti | 131/187 |
| 4,141,369 | 2/1979 | Burruss | 131/171 A |
| 4,164,230 | 8/1979 | Pearlman | 131/171 R |
| 4,193,411 | 3/1980 | Faris et al. | 131/171 R |
| 4,215,708 | 8/1980 | Bron | 131/262 B |
| 4,219,032 | 8/1980 | Tabatznik et al. | 131/170 A |
| 4,246,913 | 1/1981 | Ogden et al. | 131/171 A |
| 4,256,945 | 3/1981 | Carter et al. | 219/10.75 |
| 4,259,970 | 4/1981 | Green, Jr. | 31/330 |
| 4,303,083 | 12/1981 | Burruss, Jr. | 131/271 |
| 4,393,884 | 7/1983 | Jacobs | 131/273 |
| 4,431,903 | 2/1984 | Riccio | 219/238 |
| 4,436,100 | 3/1984 | Green, Jr. | 131/330 |
| 4,463,247 | 7/1984 | Lawrence et al. | 219/236 |
| 4,562,337 | 12/1985 | Lawrence | 219/421 |
| 4,570,646 | 2/1986 | Herron | 131/185 |
| 4,580,583 | 4/1986 | Green, Jr. | 131/330 |

(List continued on next page.)

FOREIGN PATENT DOCUMENTS

| | | |
|---|---|---|
| 1202378 | 1/1988 | Canada . |
| 87/104459 | 2/1988 | China . |
| 0295122 | 12/1988 | European Pat. Off. . |
| 0358002 | 3/1990 | European Pat. Off. . |
| 0358114 | 3/1990 | European Pat. Off. . |
| 0430566 | 6/1991 | European Pat. Off. . |
| 0438862 | 7/1991 | European Pat. Off. . |
| 3640917A1 | 8/1988 | Fed. Rep. of Germany . |
| 3735704A1 | 5/1989 | Fed. Rep. of Germany . |
| 61-68061 | 4/1986 | Japan . |
| WO86/02528 | 4/1986 | PCT Int'l Appl. . |
| 2132539 | 6/1984 | United Kingdom . |
| 2148079 | 5/1985 | United Kingdom . |
| 2148676 | 5/1985 | United Kingdom . |

OTHER PUBLICATIONS

Excerpt from "NASA Tech Briefs," Jul./Aug. 1988, p. 31.

"PTC Thermistors," Keystone Carbon Company product literature.

*Primary Examiner*—V. Millin
*Assistant Examiner*—Jennifer Doyle
*Attorney, Agent, or Firm*—Jeffrey H. Ingerman

[57] ABSTRACT

An article is provided in which a replaceable tobacco flavor medium is electrically heated by a set of permanent reusable heaters to evolve inhalable flavors or other components in vapor or aerosol form. Each heater heats only a portion of the available tobacco flavor medium so that a plurality of individual puffs of tobacco flavor substance can be delivered sequentially to the smoker. The tobacco flavor medium preferably contains tobacco materials.

37 Claims, 4 Drawing Sheets

U.S. PATENT DOCUMENTS

| | | | |
|---|---|---|---|
| 4,621,649 | 11/1986 | Osterrath | 131/185 |
| 4,623,401 | 11/1986 | Derbyshire et al. | 148/13 |
| 4,637,407 | 1/1987 | Bonanno et al. | 131/175 |
| 4,659,912 | 4/1987 | Derbyshire | 219/535 |
| 4,735,217 | 5/1988 | Gerth et al. | 131/273 |
| 4,771,796 | 9/1988 | Myer | 131/273 |
| 4,776,353 | 10/1988 | Lilja et al. | 131/297 |
| 4,846,199 | 7/1989 | Rose | 131/329 |
| 4,848,376 | 7/1989 | Lilja et al. | 131/352 |
| 4,874,924 | 10/1989 | Yamamoto et al. | 219/274 |
| 4,877,989 | 10/1989 | Drews et al. | 310/323 |
| 4,922,901 | 5/1990 | Brooks et al. | 128/203.26 |
| 4,937,421 | 6/1989 | Luthy | 219/272 |
| 4,945,931 | 8/1990 | Gori | 131/355 |
| 4,947,874 | 8/1990 | Brooks et al. | 131/329 |
| 4,947,875 | 8/1990 | Brooks et al. | 131/330 |
| 4,966,171 | 10/1990 | Serrano et al. | 131/194 |
| 4,981,522 | 1/1991 | Nichols et al. | 131/274 |
| 4,991,606 | 2/1991 | Serrano et al. | 131/359 |
| 5,095,921 | 3/1992 | Losee et al. | 131/194 |
| 5,144,962 | 9/1992 | Count et al. | 131/194 |

13
11
25
26
10
12
3A
3A
21

13
11
22
24
25
26
20
43
12
10
3
3
23
30
21
27
28

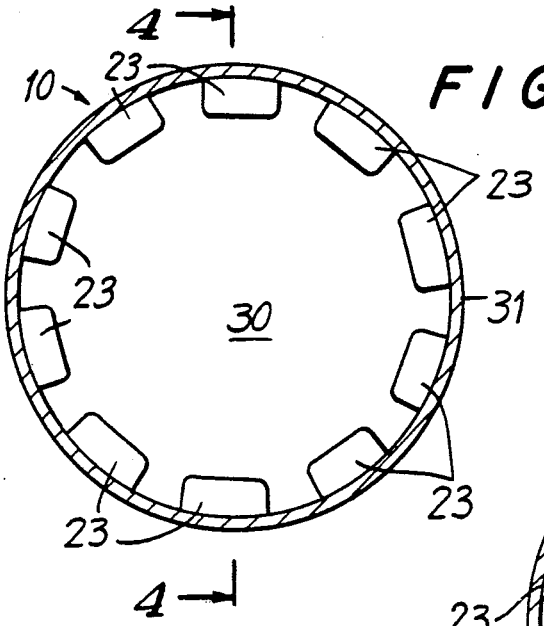
FIG. 3
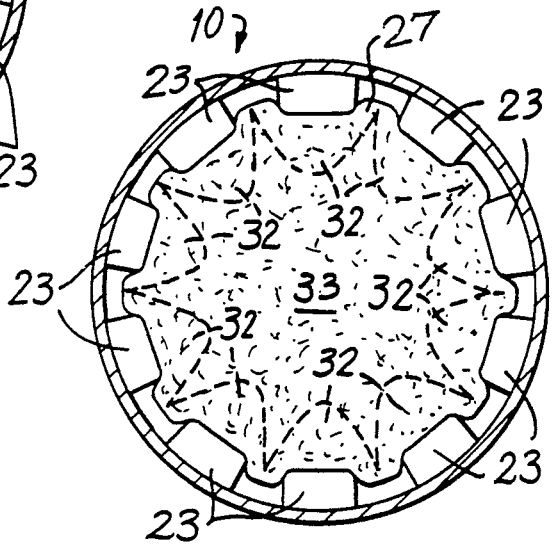
FIG. 3A
FIG. 4
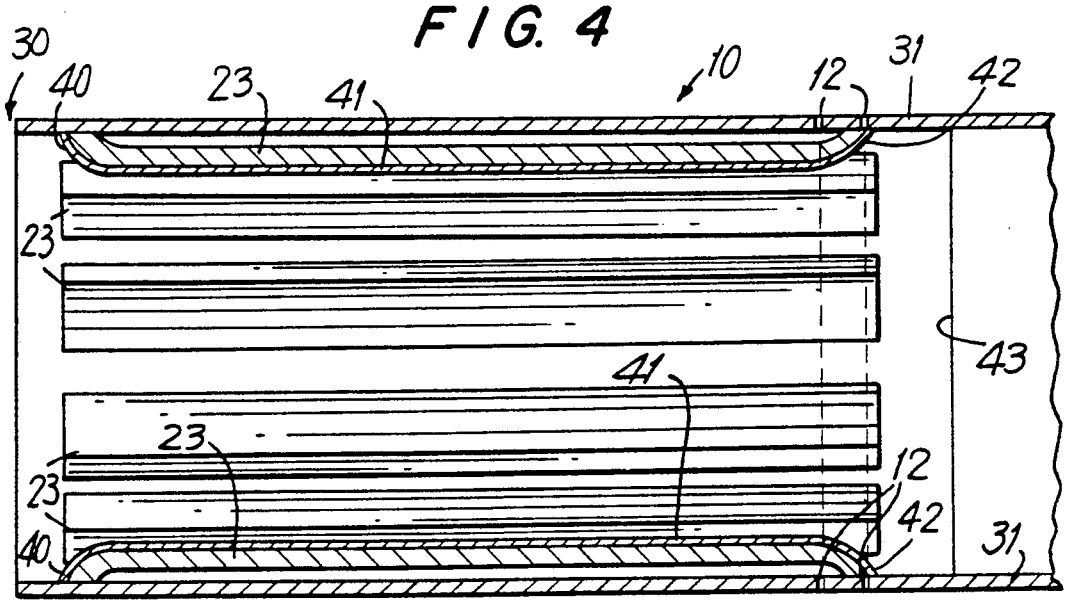

ELECTRICAL SMOKING

CROSS REFERENCE TO RELATED APPLICATION

This application is a continuation of copending U.S. patent application Ser. No. 07/666,926, filed Mar. 11, 1991, now abandoned.

BACKGROUND OF THE INVENTION

This invention relates to smoking articles in which tobacco flavor media are heated but not burned to release tobacco flavors. More particularly, this invention relates to electrical smoking articles.

An electrical smoking generating article is described in commonly-assigned U.S. patent application Ser. No. 07/444,746, filed Dec. 1, 1989, now U.S. Pat. No. 5,060,671, which was copending with parent application Ser. No. 07/666,926, filed Mar. 11, 1991, and which is hereby incorporated by reference in its entirety. That application describes an electrical smoking article which is provided with a disposable set of electrical heating elements on each of which is deposited an individual charge of tobacco flavor medium containing, for example, tobacco or tobacco-derived material. The disposable heater/flavor unit is mated to a more or less permanent unit containing a source of electrical energy such as a battery or capacitor, as well as control circuitry to actuate the heating elements in response to a puff by a smoker on the article or the depression of a manual switch. The circuitry is designed so that at least one but less than all of the heating elements are actuated for any one puff, so that a pre-determined number of puffs, each containing a premeasured amount of tobacco flavor substance, is delivered to the smoker. The circuitry also preferably prevents the actuation of any particular heater more than once, to prevent overheating of the tobacco flavor medium thereon and consequent production of undesired compounds yielding off tastes.

In such an article, the heating elements are disposed of along with the spent tobacco flavor medium. This results in increased costs to the smoker, who must buy new heating elements with each refill of tobacco flavor medium. The volume of material disposed of is also greater when the heating elements must be disposed of.

In addition, when the heating elements are not permanently attached to the article, there is sometimes excessive contact resistance where the removable heaters are electrically connected to the source of electrical energy, resulting in increased power consumption.

Also, when the heating elements are disposable, the resistance may vary from heater to heater, resulting in variations in power consumption when in turn lead to variations in temperature. As it is the temperature to which the tobacco flavor generating medium is heated that determines the characteristics of the tobacco flavor substance, those characteristics will also vary.

It would therefore be desirable to be able to provide an electrical smoking article in which the heating elements are reusable, and of which all disposable portions are biodegradable.

It would also be desirable to be able to provide such an article in which electrical contact resistance between the heaters and the source of electrical energy is minimized.

It would further be desirable to be able to provide such an article in which variation from use to use in the temperature of the heating elements is minimized.

SUMMARY OF THE INVENTION

It is an object of this invention to provide an electrical smoking article in which the heating elements are reusable, and of which all disposable portions are biodegradable.

It is also an object of this invention to provide such an article in which electrical contact resistance between the heaters and the source of electrical energy is minimized.

It is a further object of this invention to provide such an article in which variations from use to use in the temperature of the heating elements is minimized.

In accordance with this invention there is provided a smoking article for delivering to a smoker an inhalable tobacco flavor substance. The article includes a plurality of electrical heating means disposed in a cavity, a source of electrical energy for powering the plurality of electrical heating means, control means for applying the electrical energy to the electrical heating means to heat, at any one of a predetermined number of times, at least one but fewer than all of the plurality of electrical heating means, and a removable portion of tobacco flavor medium received in the cavity in contact with the plurality of electrical heating means. When any one of the plurality of electrical heating means is activated, a respective fraction of the removable portion of tobacco flavor medium in contact with that one of the heating means is heated, delivering a predetermined quantity of tobacco flavor substance to the smoker.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 3 is a radial cross-sectional view of the electrical smoking article of FIGS. 1 and 2, taken from line 3—3 of FIG. 2;

FIG. 3A is a radial cross-sectional view of the electrical smoking article of FIGS. 1-3, taken from line 3A—3A of FIG. 1;

FIG. 4 is a longitudinal cross-sectional view of the flavor cartridge receiving cavity of the electrical smoking article of FIGS. 1-3A, taken from line 4—4 of FIG. 3;

DETAILED DESCRIPTION OF THE INVENTION

Figures 1, 2:
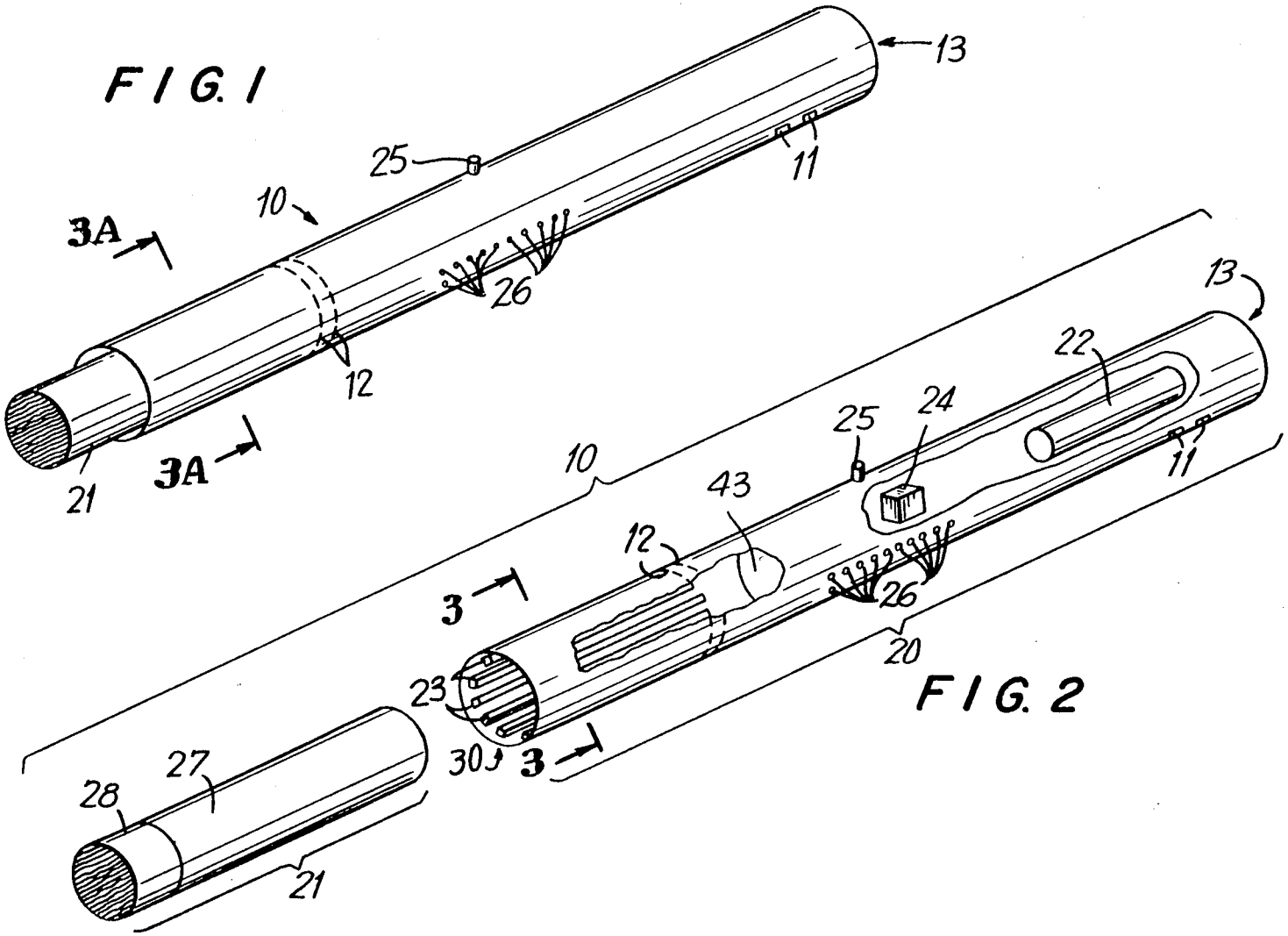
FIG. 1 is a perspective view of an electrical smoking article according to this invention.
FIG. 2 is a partially fragmentary, exploded perspective view of the electrical smoking article of FIG. 1.

An electrical smoking article according to the present invention can be used, for example, to simulate a cigarette. In such a case, the tobacco flavor medium would be a material containing tobacco or tobacco derivatives. In accordance with the invention, the electrical article would include a removable disposable portion which included the tobacco flavor medium and, if desired, a filter, and a reusable "permanent" portion including a source of electrical energy, a set of reusable heating elements, and control circuitry for energizing the heaters in an appropriate sequence, in response to manual actuation or puff-induced actuation. Suitable control circuitry is described in above-incorporated copending, commonly-assigned patent application Ser. No. 07/444,746, filed Dec. 1, 1989, now U.S. Pat. No. 5,060,671.

The reusable or permanent portion includes a cavity at the mouth end thereof for insertion of the disposable portion. The reusable heaters are disposed in the cavity in such a way that they make thermal contact with the disposable portion when the disposable portion is inserted into the cavity. This can be accomplished by having the heaters protrude from the sides of the cavity and making the disposable portion compressible, so that the heaters press into the material. Alternatively, the heaters can protrude from the end of the cavity, so that they actually pierce and extend into the disposable portion.

When reusable heaters are used, it is important that they be cleaned before each use. Otherwise, residues from the previous use, which might include partially oxidized, pyrolized or thermally decomposed constituents of the tobacco flavor generating medium, might be reheated, possibly giving rise to undesired compounds and off tastes being delivered to the smoker. Such residues are not of concern when the heaters are part of the disposable portion because they are never reheated, but may be of concern where reusable heaters are provided. In the present invention, the cleaning of the heaters is accomplished by the wiping action of the disposable portion against the heaters as the disposable portion is inserted. Thus the insertion end of the disposable portion pushes any residues on the heater surfaces toward the mouth end of the cavity, to, and preferably past, the ends of the heaters. For this reason, the disposable portion, while compressible, should be relatively firm, and the heaters should preferably have a smooth surface finish to assure that the wiping action is effective.

The parameters of the heaters are chosen to allow delivery of an effective amount of tobacco flavor substance—e.g., an aerosol containing tobacco flavors—to the consumer under standard conditions of use. For example, it may be desirable to deliver 2 mg of aerosol to a smoker during a 35 ml puff having a two-second duration.

It has been found that in order to achieve such delivery, the heaters should be able to reach a temperature of between about 150° C. and about 500° C. when in contact with the tobacco flavor medium. Further, the heaters should consume between about 1 calorie and about 6 calories, given the limitations of power sources.

Heaters having such characteristics preferably have a ratio of active surface area (surface area in contact with the tobacco flavor medium) to mass of between about 3 $mm^2/mg$ and about 6 $mm^2/mg$, an active surface area of between about 3 $mm^2$ and about 50 $mm^2$, a mass of between about 1 mg and about 30 mg, and a resistance of between about 0.5 ohm and 3.0 ohms. More preferably, the heaters should have an active surface area of between about 3 $mm^2$ and about 20 $mm^2$ and a resistance of between about 1.0 ohm and 1.6 ohms. These requirements are interrelated, because heater power consumption is determined by resistance, which in turn is determined by resistivity and size.

The materials of which the heaters are made are chosen to assure reliable repeated uses of up to 3,600 on/off cycles without failure. The heater materials are also chosen based on their reactivities, to assure that they will not react with the tobacco flavor medium at any temperature likely to be encountered to form any undesired compounds. Similarly, the heaters themselves should not evolve any undesired compounds when heated out of the presence of the tobacco flavor medium. Alternatively, heater materials that might otherwise give rise to undesired compounds could be encapsulated in an inert heat-conducting material such as a suitable ceramic material.

Based on these criteria, preferred materials for the electric heating means of the present invention include carbon, graphite, stainless steel, tantalum, metal ceramic matrices, and metal alloys, such as aluminum alloys, iron alloys, and chromium alloys. Suitable metal-ceramic matrices include silicon carbide aluminum and silicon carbide titanium. Of the listed materials, stainless steel and the aluminum, iron or chromium alloys should be encapsulated in a suitable ceramic material because of their reactivity. Suitable ceramic materials for encapsulation include silica, alumina, and sol gels.

A particularly preferred material for use in the electrical heating means of this invention is tantalum.

A first preferred embodiment of an electrical smoking article 10 according to the invention is shown in FIGS. 1–4. Article 10 includes reusable or "permanent" portion 20 and disposable filter/flavor portion or cartridge 21 which is received in a cavity 30 at the mouth end of portion 20.

Reusable portion 20 includes, at the end remote from the mouth end, a power source 22, which could include a battery, a capacitor or both. The battery could be replaceable, rechargeable or both. If the battery is rechargeable, or if power source 22 is a capacitor alone, then article 10 is provided with charging contacts 11 on its outer surface, for connection to an external power supply (not shown) for charging power source 22. Power source 22 provides power for heating elements 23, which are energized under the control of control circuit 24, which is in turn actuated by pushbutton 25 or by a puff-actuated sensor (not shown). Indicators 26, which could be light-emitting diodes or other visual indicators, reflect the status of the various heaters 23. The functions of power source 22, control circuit 24, pushbutton 25 (or a puff-actuated sensor), and indicators 26 are described in more detail in above-incorporated copending, commonly-assigned patent application Ser. No. 07/444,746, filed Dec. 1, 1989, now U.S. Pat. No. 5,060,671. Portion 20 is preferably covered by cigarette wrapping paper 31, to give it the appearance of a conventional cigarette. Perforations 12 may be provided in the wall of portion 20 to allow outside air to be drawn in during puffing, or outside air may be drawn through all of portion 20 via openings (not shown) at its far end 13.

In this embodiment, heating elements 23 are linear, extending from a point slightly spaced away from the mouth end of cavity 30 to a point slightly spaced away from the rod end of cavity 30. As seen in FIG. 4, heating elements 23 are bowed slightly away from the wall of cavity 30, for reasons to be discussed below. At one of the two ends, all of heating elements 23 are connected in common to ground, while at the other end each element 23 is connected separately to control circuitry 24 for individual actuation of heating elements 23. The curvature of ends 40 of heating elements 23 at the mouth end of cavity 30 provides a lead-in for the insertion of disposable portion 21. Heating elements 23 are preferably distributed substantially uniformly around the circumference of cavity 30, and should preferably be spaced apart sufficiently that the regions of disposable portion 21 heated by neighboring heating elements 23 do not overlap, which could lead to reheating and the production of undesired compounds and off tastes.

Disposable portion 21 preferably includes a flavor segment 27 and a filter segment 28, attached by a plug wrap or other fastening means (not shown). Filter segment 28 is preferably a conventional cellulose acetate filter segment, and preferably is very short, being provided mostly for the sake of appearance and to give article 10 a "mouth feel" similar to a conventional cigarette.

Flavor segment 27 can be any material that liberates flavors when hot air passes over or through it. Preferably, flavor segment 27 is a cylindrical portion of an extruded open-cell foamed tobacco product of the kind described in commonly-assigned U.S. Pat. No. 4,510,950, which is hereby incorporated by reference in its entirety, except that approximately 10% of an aerosol precursor such as glycerine is added to the composition. It is desirable to add an aerosol precursor to deliver the tobacco flavor substance as an aerosol, so that when the consumer exhales the tobacco flavor substance, the visible condensed aerosol may mimic the appearance of cigarette smoke.

The diameter of filter/flavor portion 21 is at most equal to the inner diameter of cavity 30, and should be at least somewhat greater than the diameter of the cylindrical space between heating elements 23, which are bowed out from the wall of cavity 30 as discussed above, so that elements 23 press into flavor segment 27 for intimate thermal contact. To that end, flavor segment 27 should be firm but compressible. The open-cell foamed structure described in above-incorporated U.S. Pat. No. 4,510,950 is particularly well-suited for that purpose, but other compressible structures may be used.

The compression of flavor segment 27 by heating elements 23 is illustrated in FIG. 3A, which shows a radial cross-sectional view of article 10 with disposable portion 21 inserted. FIG. 3A also shows regions 32 of flavor segment 27 adjacent heaters 23, each region 32 representing that fraction of segment 27 that is heated by each respective heater 23 to provide an individual charge of tobacco flavor substance.

The length of portion 21 is preferably such that some part of filter segment 28 protrudes from cavity 30 to aid removal of spent portions 21. However, portion 21 could be inserted flush into cavity 30, and a separate ejection mechanism (not shown) could be provided. Whatever length portion 21 is made, the relative lengths of segments 27, 28 preferably should be such that all of filter segment 28 is closer to the mouth end of cavity 30 than the ends 40 of heating elements 23, so that no energy is wasted heating filter segment 28.

As discussed above, a wiping action cleans residue from previous uses off heating elements 23 as each new disposable portion 21 is inserted, and that preferably is aided by smooth surface finish 41 on the surface of heating elements 23. (Although drawn separately from elements 23, surface finish 41 need not be, and preferably is not, a separate layer.) The resilience of firm but compressible portion 21 assures firm contact for the wiping action. Preferably also, the ends 42 of heating elements 23 remote from the mouth end are connected to the side wall of cavity 30 adjacent to, but spaced away from, end wall 43 of cavity 30. That allows the residue that is wiped off heating elements 23 to be pushed past ends 42 of heating elements 23 so that residue is not reheated.

Figure 5:
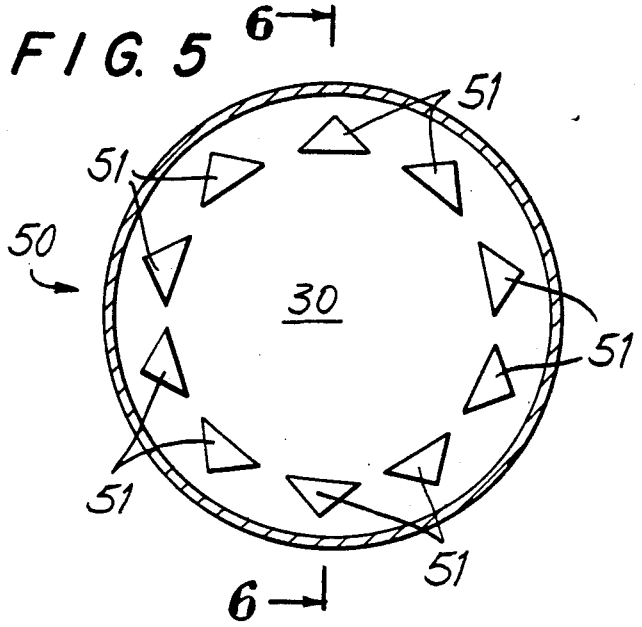
FIG. 5 is a radial cross-sectional view similar to FIG. 3 of the electrical smoking article of the invention, showing an alternative heater embodiment.
Figure 6:
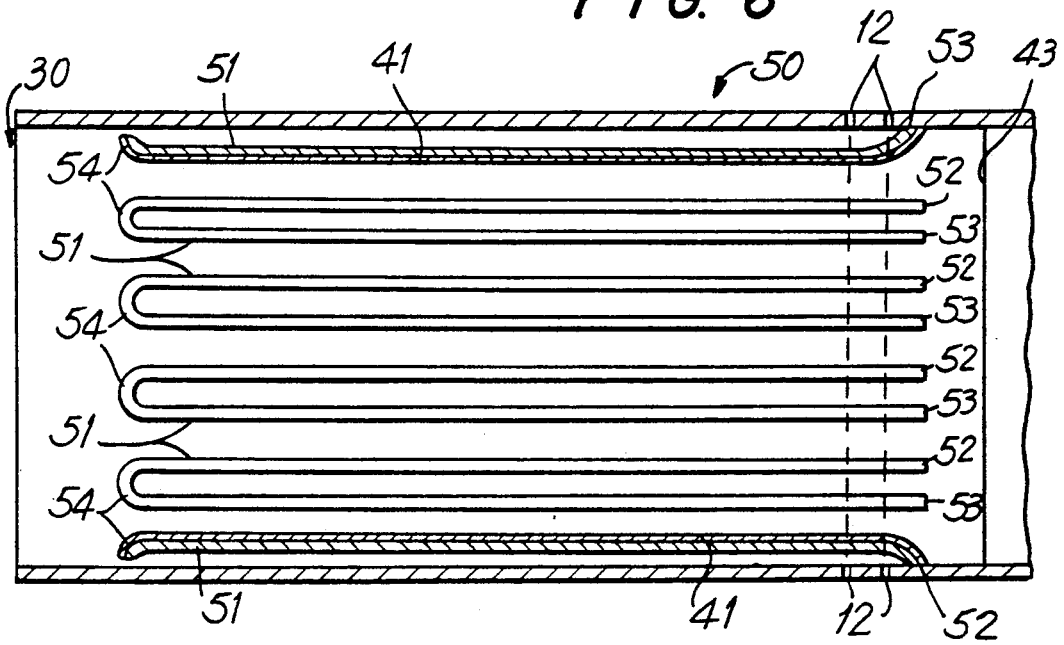
FIG. 6 is a longitudinal cross-sectional view of the flavor cartridge receiving cavity of the electrical smoking article of FIG. 5, taken from line 6—6 of FIG. 5.

As discussed above, in embodiment 10 of FIGS. 1–4, the electrical connections to heating elements 23 are made at both ends 40, 42 thereof, requiring the extension of wires or other conductors to the mouth end of cavity 30. That requirement is eliminated in a more particularly preferred embodiment 50, which is identical to embodiment 10 except for the arrangement of heating elements 51 as illustrated in FIGS. 5 and 6.

Each heating element 51 is in the shape of an elongated "U", each having both of its ends 52, 53 connected to the side wall of cavity 30 adjacent end wall 43 of cavity 30. Each respective end 52 is individually connected to control circuitry 24 for individual actuation of heating elements 51, while ends 53 are connected in common to ground. While ends 54 adjacent the mouth end of cavity 30 are not electrically connected, and thus need not touch the side wall of cavity 30, they are nonetheless turned toward the side wall of cavity 30, as shown in both FIGS. 5 and 6, to provide a lead-in for disposable portion 21 as discussed above. It should be noted that in FIG. 6, the uppermost and lowermost elements 51 are shown cut through their U-shaped tips 54.

Figure 7:
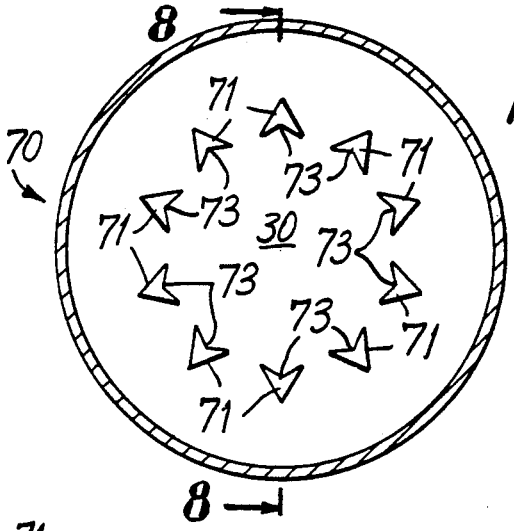
FIG. 7 is a radial cross-sectional view similar to FIGS. 3 and 5 of the electrical smoking article of the invention, showing another alternative heater embodiment.
Figure 8:
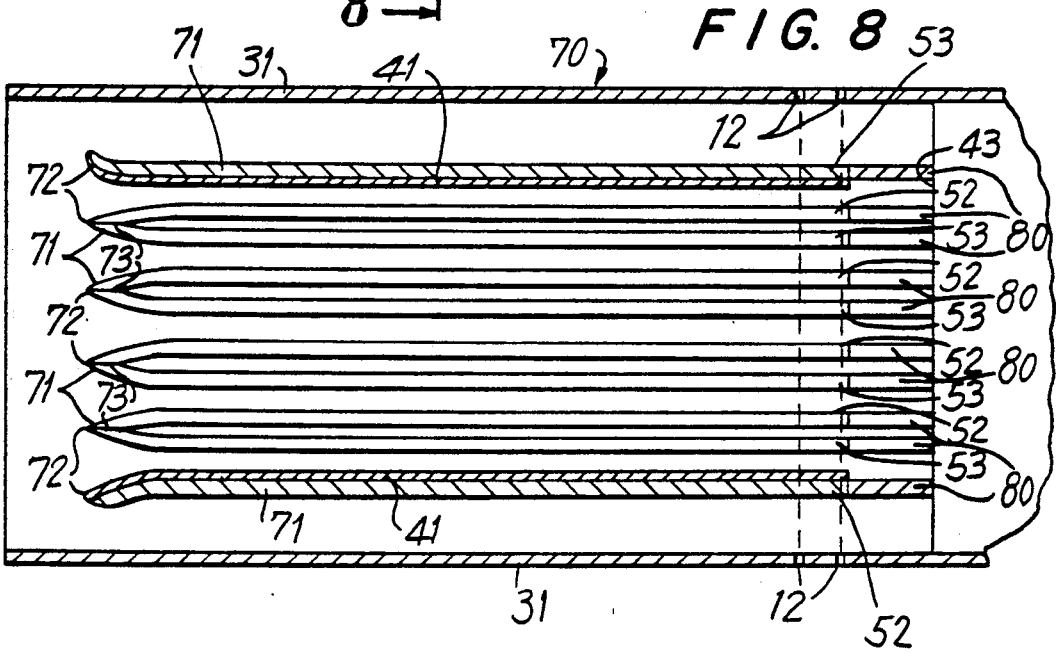
FIG. 8 is a longitudinal cross-sectional view of the flavor cartridge receiving cavity of the electrical smoking article of FIG. 7, taken from line 8—8 of FIG. 7.

In another embodiment 70 shown in FIGS. 7 and 8, heating elements 71 are spaced somewhat further from the wall of cavity 30, and each is provided with a somewhat sharper "V" tip 72, as well as with fold 73 to increase their rigidity. In this way, heating elements 71 actually pierce and extend into disposable portion 21 to provide the desired intimate thermal contact. The open-cell foam structure described above is particularly well-suited for such an embodiment. In this embodiment, because heating elements 71 are spaced further from the side wall of cavity 30, ends 52, 53 are not attached to the side wall of cavity 30, but to its end wall 43. Preferably, the connections of ends 52, 53 to end wall 43 are made through spacers 80 which are not conductive of either heat or electricity. In this way, the wiping action referred to above wipes residue past ends 52, 53 and onto spacers 80, where the residues are not reheated.

Figure 9:
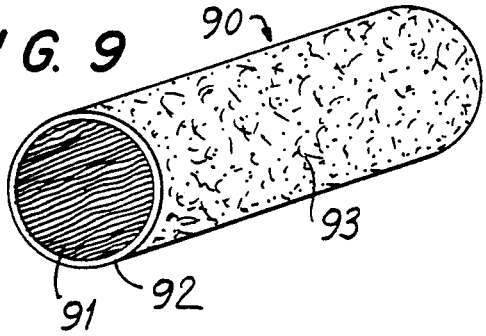
FIG. 9 is a perspective view of an alternative embodiment of a flavor cartridge according to the present invention.
Figure 10:
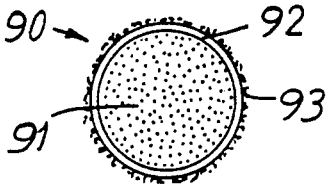
FIG. 10 is an end elevational view of the flavor cartridge of FIG. 9, taken from line 10—10 of FIG. 9.

An alternative embodiment of flavor segment 27 of disposable portion 21 is shown in FIGS. 9 and 10. Flavor segment 90 includes a fiber bundle 91 around which is wrapped a layer 92 of metallic foil, such as aluminum foil, onto which has been coated a slurry 93 of tobacco flavor medium. Fiber bundle 91 gives segment 90 the necessary compressibility. This alternative avoids the inefficient use of tobacco that occurs in segment 27, where the tobacco foam region 33 (FIG. 3A) in the center of segment 27 provides bulk and compressibility but is never heated to deliver flavor to the smoker. Furthermore, if this embodiment 90 is used, fiber bundle 91 could be made of cellulose acetate or other suitable filter material, and could be extended to form filter segment 28, thereby providing disposable portion 21 as a unitary body.

Thus it is seen that an electrical smoking article is provided in which the heating elements are reusable, and of which all disposable portions can be biodegradable. In addition, electrical contact resistance between the heaters and the source of electrical energy is eliminated, as the heaters are permanently attached. One skilled in the art will appreciate that the present invention can be practiced by other than the described embodiments, which are presented for purposes of illustration and not of limitation, and the present invention is limited only by the claims which follow.

What is claimed is:

1. An electrical smoking article for delivering to a smoker an inhalable tobacco flavor substance, said article comprising:

a plurality of electrical heating means disposed in a cavity;

a source of electrical energy for powering said plurality of electrical heating means;

control means for applying said electrical energy to said electrical heating means to heat, at any one of a predetermined number of times, at least one but fewer than all of said plurality of electrical heating means; and a removable portion of tobacco flavor medium received in said cavity in proximity to said plurality of electrical heating means; whereby:

when any one of said plurality of electrical heating means is activated, a respective fraction of said removable portion of tobacco flavor medium in contact with said one of said heating means is heated, delivering a predetermined quantity of tobacco flavor substance to said smoker.

2. The article of claim 1 wherein said removable portion of tobacco flavor medium contains a sufficient quantity of tobacco flavor medium to deliver said predetermined quantity of tobacco flavor substance to said smoker once for each activation of each of said plurality of electrical heating means; wherein:

said removable portion is spent after one activation of each of said plurality of electrical heating means; and said removable portion is replaceable by said smoker when it is spent.

3. The article of claim 1 wherein said cavity and said removable portion are substantially cylindrical and have substantially the same diameter.

4. The article of claim 3 wherein said removable portion is longer than said cavity and has an end protruding from said cavity, said protruding end providing a grip for said smoker for insertion and removal of said portion.

5. The article of claim 1 wherein:

each of said plurality of electrical heating means protrudes into said cavity; and said removable portion is compressible; whereby:

said removable portion is compressed by and adjacent each of said plurality of electrical heating means, providing intimate thermal contact therebetween.

6. The article of claim 1 wherein:

each of said plurality of electrical heating means protrudes into said cavity; and said removable portion is compressible; whereby:

each of said plurality of electrical heating means extends into said removable portion, providing intimate thermal contact therebetween.

7. The article of claim 1 wherein:

said cavity has an insertion end through which said removable portion is inserted and a far end remote from said insertion end; and when said removable portion is inserted into said cavity, said removable portion wipes from each of said plurality of electrical heating means any residue remaining from a previously heated removable portion.

8. The article of claim 7 wherein each of said plurality of electrical heating means is spaced from said far end, whereby when said removable portion is inserted into said cavity, said removable portion wipes said residue beyond each of said plurality of electrical heating means in the direction of said far end.

9. The article of claim 7 wherein said removable portion is compressible.

10. The article of claim 1 wherein said tobacco flavor medium comprises an extruded tobacco material.

11. The article of claim 10 wherein said extruded tobacco material is a tobacco foam material.

12. The article of claim 11 wherein said tobacco foam material is an open-cell foam.

13. The article of claim 11 wherein:

said tobacco foam material comprises an aerosol-forming material; and when said tobacco flavor medium is heated, an aerosol comprising tobacco components is formed.

14. The article of claim 13 wherein said aerosol-forming material comprises glycerine.

15. The article of claim 1 wherein:

said tobacco flavor medium comprises tobacco; and when said tobacco flavor medium is heated, a tobacco flavor substance comprising tobacco components is formed.

16. The article of claim 1 wherein:

said tobacco flavor medium comprises an aerosol-forming material; and when said tobacco flavor medium is heated, an aerosol is formed.

17. The article of claim 16 wherein said aerosol-forming material comprises glycerine.

18. The article of claim 17 wherein said aerosol-forming material further comprises water.

19. The article of claim 16 wherein said aerosol-forming material comprises water.

20. The article of claim 1 wherein:

said tobacco flavor medium comprises tobacco and an aerosol-forming material; and when said tobacco flavor medium is heated, an aerosol comprising tobacco components is formed.

21. The article of claim 20 wherein said tobacco flavor medium further comprises tobacco solubles.

22. The article of claim 20 wherein said aerosol-forming material comprises glycerine.

23. The article of claim 22 wherein said aerosol-forming material further comprises water.

24. The article of claim 20 wherein said aerosol-forming material comprises water.

25. The article of claim 1 wherein said electrical heating means has a resistance of between about 0.5 ohm and about 3.0 ohms.

26. The article of claim 25 wherein said electrical heating means has a resistance of between about 1.0 ohm and 1.6 ohms.

27. The article of claim 1 wherein said electrical heating means produces a temperature of between about 150° C. and about 500° C. when in contact with said tobacco flavor medium.

28. The article of claim 1 wherein said electrical heating means consumes between about 1 calorie and about 6 calories each time it is heated.

29. The article of claim 1 wherein said electrical heating means has a ratio of active surface area to mass of between about 3 $mm^2/mg$ and about 6 $mm^2/mg$.

30. The article of claim 29 wherein said electrical heating means has an active surface area of between about 3 $mm^2$ and about 50 $mm^2$, and a mass of between about 1 mg and about 30 mg.

31. The article of claim 30 wherein said electrical heating means has an active surface area of between about 3 $mm^2$ and about 20 $mm^2$.

32. The article of claim 1 wherein said electrical heating means comprises a material selected from the group consisting of carbon, graphite, stainless steel, tantalum, metal ceramic matrices, and metal alloys.

33. The article of claim 32 wherein said metal alloys are selected from the group consisting of aluminum alloys, iron alloys, and chromium alloys.

34. The article of claim 32 wherein said metal ceramic matrices are selected from the group consisting of silicon carbide aluminum, silicon carbide titanium, and mixtures thereof.

35. The article of claim 32 wherein said material comprises tantalum.

36. The article of claim 32 wherein said material is encapsulated in a ceramic coating.

37. The article of claim 1 wherein said removable portion has a mouth end and a rod end, said removable portion further comprising a filter at said mouth end.

* * * * *